United States Patent [19]

Alexander

[11] 3,964,649

[45] June 22, 1976

[54] PRESSURIZED DISPENSING CONTAINER

[75] Inventor: David John Alexander, Twickenham, England

[73] Assignee: Lever Brothers Company, New York, N.Y.

[22] Filed: Jan. 30, 1975

[21] Appl. No.: 545,290

[52] U.S. Cl. ..... 222/399

[51] Int. Cl.[2] ..... B65D 83/14

[58] Field of Search ..... 222/192, 386.5, 399, 222/3

[56] References Cited

UNITED STATES PATENTS

| | | | |
|---|---|---|---|
| 1,608,155 | 11/1926 | Barnebey | 222/3 |
| 2,962,196 | 11/1960 | Ayres | 222/399 |
| 3,122,284 | 2/1964 | Miles | 222/399 |
| 3,858,764 | 1/1975 | Watson | 222/399 |

*Primary Examiner*—Allen N. Knowles
*Assistant Examiner*—Hadd Lane
*Attorney, Agent, or Firm*—James J. Farrell; Kenneth F. Dusyn; Melvin H. Kurtz

[57] ABSTRACT

A pressurized dispensing device contains a fluid product, either a dry powder or a liquid, to be dispensed and a reservoir containing a propellant sorbed by a sorbent material, the reservoir having a vapor-permeable wall to permit propellant gas to pass through and pressurize the headspace of the device.

5 Claims, 3 Drawing Figures

PRESSURIZED DISPENSING CONTAINER

Figure 1:
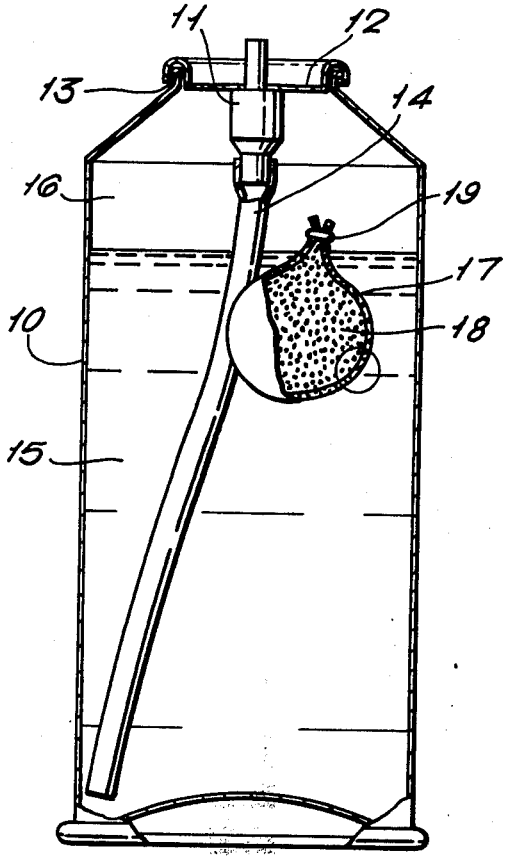

The invention relates to a pressurised dispensing device in which the liquefied propellant gas is separated from a fluid product which is to be dispensed.

U.S. Pat. No. 3,081,223 describes an aerosol system for dispensing a powder in a substantially liquid-free gaseous stream in which a liquefied propellant gas is sorbed by the powder. In a modification of this system a powdered sorbent material is employed to sorb the liquefied propellant gas rather than the product to be dispensed being used as the sorbent. The propellant vapour escapes from the sorbent material into the headspace of the dispensing device, which is thereby pressurised, and on actuating the valve the entrapped vapour expels the powdered product from the container.

A disadvantage of this system is that sorbent material containing liquefied propellant gas can be expelled from the pressurised dispensing container together with the powdered product which is dispensed.

We have now discovered that this disadvantage can be avoided by enclosing the sorbent material in a special reservoir and that this arrangement gives increased versatility.

The invention accordingly provides a pressurised dispensing device containing a fluid product to be dispensed and a reservoir, containing a propellant sorbed by a sorbent material, the reservoir having a vapour-permeable wall to permit propellant gas to pass through and pressurise the headspace of the device.

The term "sorbed" is used to include both "adsorbed" i.e. sorbed on the surface and "absorbed", i.e. sorbed in the body or interior. Similarly the term "sorbent" is used to include materials which either adsorb, absorb or both.

The term "vapour permeable" means that gas or vapour, such as propellant gas, is capable of permeating through the wall material which separates the reservoir from the fluid product in the device.

An advantage of the invention is that it allows fluid products to be dispensed from a pressurised dispensing device without the simultaneous dispensation of liquefied propellant gas. With aqueous products, it is preferred that the sorbent material has a hydrophobic surface in order to avoid displacement of the sorbed liquefied propellant gas by water. Examples of aqueous products are a shampoo or a hair colourant, a water-continuous emulsion such as a hand crean or shaving preparation, or a suspension of a finely-divided solid in a liquid, such as an antiperspirant or a toothpaste. The invention is however not confined to pressurised dispensing devices containing aqueous liquids: the fluid product which is to be dispensed may, for example, be a powder such as talcum powder or any other body powder, an insecticide or other agricultural composition or a pharmaceutical composition.

The liquefied propellant gas can be any of the usual ones such as a liquefied hydrocarbon for example propane or isobutane, a liquefied chloro- or fluorohydrocarbon such as difluorodichloromethane or any of the other propellants supplied under such Trade Marks as "Arcton", "Fluon" and "Freon".

The sorbent substance can be any substance which will reversibly absorb and adsorb a liquefied propellant gas in a sufficient amount to provide a pressure of from about 10 to 70 psig in the headspace of the pressurised dispensing can and will preferably have a hydrophobic surface. We have found various particulate silicas and methylated silicas to be suitable for use as sorbent substances in the pressurised dispensing devices of the invention. A hydrophobic silica will reversibly absorb as much as 70% of its own weight of liquefied propellant gas.

Further examples of sorbent substances are precipitated silicas, such as aluminium silicate and magnesium silicate, fumed amorphous silicas, hydrated light alumina, absorbent cotton, felt, fibre matting, pumice stone, expanded vermiculite, powdered aluminium.

Suitable for use as a reservoir having a vapour-permeable wall are envelopes and sachets constructed from open cell plastics foam such as polyvinyl chloride, polyethylene or polyproylene foams, particularly those having a woven backing. It is also possible to use non-woven felts made from plastics materials such as polypropylene fibres or made from cellulosic fibrous material.

When using organic liquefied propellant gases, the fluid product to be dispensed is preferably one which does not absorb the gas although this is not essential.

If it is intended that the emulsion should be dispensed as a foam, dissolution of liquefied propellant gas in the product will be necessary. Accordingly, the liquid product to be dispensed may comprise a liquefied propellant gas.

Examples of pressurised dispensing devices containing formulations in accordance with the invention are as follows:

EXAMPLE 1

The following is a formulation of a hand cream composition:

| | %(w/w) |
|---|---|
| myristic acid | 1.33 |
| stearic acid | 5.33 |
| cetyl alcohol | 0.47 |
| lanolin, anhydrous | 0.20 |
| isopropyl myristate | 1.33 |
| glycerine | 4.66 |
| polyvinyl pyrrolidone | 0.33 |
| triethanolamine | 3.33 |
| perfume | 0.56 |
| demineralised water | 82.46 |

120 g of the above formulation were packed into a 6 oz capacity pressurised dispensing device with a vapour-permeable sachet containing 1.5 g hydrophobic silica which had been previously immersed in liquid Arcton 12.

EXAMPLE 2

The following is a formulation of a shampoo composition:

| | %(w/w) |
|---|---|
| triethanolamine lauryl sulphate | 32.20 |
| stearic acid | 6.80 |
| lanolin anhydrous | 0.40 |
| benzyl alcohol | 2.00 |
| triethanolamine | 0.80 |
| potassium hydroxide | 0.60 |
| perfume | 0.50 |
| demineralised water | 56.70 |

120 g of the above shampoo forulation were packed into a 6 oz capacity pressurised dispensing device with a vapour-permeable sachet containing 2.0 g of hydrophobic silica which had been previously immersed in liquefied Arcton 12.

EXAMPLE 3

The following is a formulation of a shaving cream composition:

| | %(w/w) |
|---|---|
| Myristic acid | 2.00 |
| stearic acid | 4.00 |
| lanolin | 0.40 |
| cetyl alcohol | 0.50 |
| triethanolamine | 3.00 |
| propylene glycol | 3.00 |
| Tween 20 | 5.00 |
| Tween 80 | 5.00 |
| borax | 0.10 |
| polyvinyl pyrrolidone | 1.00 |
| perfume | 1.00 |
| demineralised water | 75.00 |

150 g of the above shaving cream formulation were filled into a 6 oz capacity pressurised dispensing device and sealed in a vapour-permeable sachet containing 2.0 g of hydrophobic silica which had been previously immersed in a liquefied Arcton 12. Then 6 g of dichlorotetrafluoroethane was introduced via the valve of the pressurised dispensing device into the formulation and the device was shaken to achieve emulsification in the shaving cream base.

The vapour-permeable sachet as the sorbed propellant reservoir used in the above examples was prepared as follows. Particulate methylated silica was sealed into a sachet constructed from polyvinyl chloride foam backed with a woven cloth material. The preformed sachet was then immersed in propellant gas liquefied by refrigeration, drained and added to the pressurised dispensing device.

In an alternative method of preparation the propellant can be applied to the sorbent in gaseous form under pressure when the sorbent is in the pressurised dispensing device.

The pressurised dispensing device of the invention exhibits considerable advantages over those of the prior art.

Firstly, since no liquefied propellant gas escapes with the product which is dispensed, it is unnecessary to use as much propellant as is normal. This can result in a considerable economic saving. Also, by virtue of the fact that no liquefied propellant gas is dispensed, the devices are suitable for the packaging of products, such as foods, which normally cannot employ halocarbons as propellants.

Secondly, the devices enable liquefied propellant gases which are easily hydrolysed to be used in aqueous systems since there is no contact between the liquefied propellant gas and water. This lack of contact (and therefore reduced hydrolysis) also results in a reduction in the corrosion of the pressurised dispensing device and in a reduction of off-colours and off-odours in the product which is dispensed.

Figure 2:
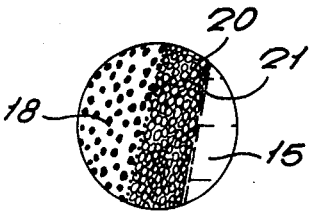
Figure 3:
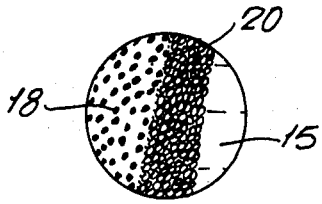

The invention will be further described with reference to the accompanying diagrammatic drawings in which:

FIG. 1 represents a vertical section through a pressurised dispensing device in accordance with the invention, and FIGS. 2 and 3 represent enlarged views of two embodiments of the portion circled in FIG. 1.

The pressurised dispensing device consists of a body component 10 having sloping shoulders and an open neck and base. A dispensing valve 11 set in flange 12 is attached to the neck of the body component 10 at swaged joint 13. Dependant from this valve is a diptube 14 extending into the body component 10.

The device contains a liquid product 15 to be dispensed, leaving headspace 16. Partially immersed in the liquid product 15 is a sachet 17 containing particulate methylated silica 18 in which is absorbed a liquefiable gas propellant. The sachet 17 is sealed at closure 19. Details of the construction of sachet 17 are shown in FIGS. 2 and 3. In one embodiment (FIG. 2) the wall of sachet 17 is constructed from polyvinyl chloride foam 20 backed with a woven cloth material 21. In another embodiment (FIG. 3), the wall of sachet 17 is constructed from polyvinyl chloride foam 20 without a woven cloth backing.

When assembling the pressurised dispensing device, the sealed sachet 17 containing particulate methylated silica 18 is immersed in a suitable liquefied gas propellant which permeates the wall of the sachet and becomes absorbed on the particulate methylated silica. At the same time, the body component 10 is charged with the product to be dispensed allowing sufficient headspace for insertion of the sachet 17.

The sachet 17 is removed from the liquefied gas propellant, dropped into the liquid product 15 contained in the body component 10 and the dispensing valve 11 with diptube 14 is immediately fitted by swaging to the body component at joint 13. A small amount of propellant vapour diffuses out of the sachet 17 to pressurise the dispensing device and to maintain the pressure within the device after each occasion when product has been dispensed.

What is claimed is:

1. In a pressurized dispensing device containing a fluid product to be dispensed, the improvement comprising a reservoir containing a liquefied propellant gas selected from the group consisting of liquefied hydrocarbons, liquefied chlorohydrocarbons and liquefied fluorohydrocarbons, the propellant being sorbed by a particulate hydrophobic silica, the reservoir comprising a vapour permeable envelope of open cell plastics foam to permit propellant gas to pass through and pressurize the headspace of the device.

2. The improved pressurised dispensing device of claim 1, wherein the foam has a woven backing and is constructed from open-cell plastic foams selected from the group consisting of polyvinyl chloride, polyethylene and polypropylene foams.

3. The improved pressurised dispensing device of claim 1, wherein the fluid product is selected from the group consisting of shampoos, hair colourants, handcreams, shaving preparations, antiperspirants and toothpastes.

4. The improved pressurized dispensing device of claim 1, wherein the hydrophobic silica is a methylated silica.

5. In a pressurized dispensing device containing a fluid product to be dispensed, the improvement comprising a reservoir containing a liquefied propellant gas selected from the group consisting of liquefied hydrocarbons, liquefied chlorohydrocarbons, liquefied fluorohydrocarbons, the propellant being sorbed by a particulate hydrophobic silica, the reservoir comprising a vapour permeable envelope of fibrous material selected from the group consisting of polypropylene fibres and cellulose fibres, to permit propellant gas to pass through and pressurize the headspace of the device.

* * * * *